US006533352B1

(12) United States Patent
Glass et al.

(10) Patent No.: US 6,533,352 B1
(45) Date of Patent: Mar. 18, 2003

(54) CHAIR WITH RECLINING BACK REST

(75) Inventors: Peter Glass, Napa, CA (US); Jamie Toland, Conway, AR (US)

(73) Assignee: Virco Mgmt. Corporation, Torrance, CA (US)

( * ) Notice: Subject to any disclaimer, the term of this patent is extended or adjusted under 35 U.S.C. 154(b) by 0 days.

(21) Appl. No.: 09/611,473

(22) Filed: Jul. 7, 2000

(51) Int. Cl.[7] ..... A47G 3/024

(52) U.S. Cl. ..... 297/299; 297/299; 297/301.3; 297/301.5; 297/291

(58) Field of Search ..... 297/297, 298, 297/299, 301.1, 301.3, 301.5, 326, 313, 291, 300.2

(56) References Cited

U.S. PATENT DOCUMENTS

| | | | | | |
|---|---|---|---|---|---|
| 3,602,537 | A | * | 8/1971 | Kerstholt | 297/304 |
| D247,463 | S | | 3/1978 | Müller-Deisig | |
| 4,585,272 | A | * | 4/1986 | Ballarini | 297/296 X |
| 4,776,633 | A | | 10/1988 | Knoblock et al. | |
| 4,900,085 | A | * | 2/1990 | Tobler | 297/219 |
| 4,986,601 | A | * | 1/1991 | Inoue | 297/301.1 |
| 5,037,158 | A | | 8/1991 | Crawford | |
| 5,039,163 | A | * | 8/1991 | Tolleson | 297/297 |
| 5,069,496 | A | * | 12/1991 | Kunh et al. | 297/301.1 |
| D351,291 | S | | 10/1994 | Völkle | |
| 5,486,035 | A | * | 1/1996 | Koepke et al. | 297/320 |
| 5,582,459 | A | * | 12/1996 | Hama et al. | 297/300.2 |
| 5,630,650 | A | | 5/1997 | Peterson et al. | |
| 5,678,893 | A | | 10/1997 | Bock | |
| 5,725,278 | A | | 3/1998 | Verbeek | |
| 5,775,774 | A | * | 7/1998 | Okano | 297/300.2 |
| 5,868,468 | A | * | 2/1999 | Wang | 297/320 |
| 5,887,946 | A | * | 3/1999 | Raftery | 297/297 |
| 5,951,107 | A | | 9/1999 | Tornero | |
| 5,957,534 | A | * | 9/1999 | Wilkerson et al. | 297/301.1 X |

FOREIGN PATENT DOCUMENTS

| | | | | |
|---|---|---|---|---|
| WO | WO 91/03192 | * | 3/1991 | 297/297 |

* cited by examiner

*Primary Examiner*—Lanna Mai
*Assistant Examiner*—Winnie Yip
(74) *Attorney, Agent, or Firm*—Sheldon & Mak; Denton L. Anderson; Robert M. Hupe

(57) ABSTRACT

A chair having a seat and a back rest. The back rest is attached to the seat via a back rest support element. The flat spring can be made from a non-metallic material, such as from fiberglass. The back rest support element comprises a flat spring disposed under pretension. In one embodiment, the seat is disposed upon a seat support structure having four legs. Preferably, the legs are splayed outside the perimeter of the seat, so that the chair is stackable with chairs of like design. The seat and the back rest can be made from a lightweight plastic material, and that the support structure can be made from tubular steel.

23 Claims, 4 Drawing Sheets

CHAIR WITH RECLINING BACK REST

FIELD OF THE INVENTION

This invention relates generally to chairs and, more particularly, to chairs having a reclining back rest.

BACKGROUND OF THE INVENTION

Chairs having a back rest which is rearwardly reclinable when a user leans back against it are very popular. Such chairs are generally held to be more comfortable than chairs with rigid, non-deflectable back rests.

To date, however, chairs having reclinable back rest have required complex, cumbersome and expensive constructions. Such constructions are impractical for schools and other institutional entities providing large conference centers (e.g., hotels, convention centers, etc.) Reclinable chairs of the prior art are generally too large, too expensive and too difficult to store for such institutional entities.

Accordingly, there is a need for a chair with a reclinable back which is at once compact, inexpensive to manufacture and convenient to store.

SUMMARY

The invention satisfies this need. The invention is a chair having a seat and a back rest. The back rest is attached to the seat via a back rest support element. The back rest support element comprises a flat spring disposed under pre-tension.

In one embodiment, the seat is disposed upon a seat support structure having four legs. Preferably, the legs are splayed outside the perimeter of the seat, so that the chair is stackable with chairs of like design.

In another embodiment, the back rest support element further comprises a full tilt stop tab for preventing the over-deflection of the back rest in a rearward direction and an at-rest stop tab for preventing the forward deflection of the back rest beyond a predetermined "at-rest" position.

In a typical embodiment, the seat and the backrest are made from a lightweight plastic material and the support structure is made from tubular steel.

It is also typical that the flat spring be made from a non-metallic material, such as from fiberglass.

DRAWINGS

These features, aspects and advantages of the present invention will become better understood with regard to the following description, appended claims and accompanying figures where:

DETAILED DESCRIPTION

Figure 1:
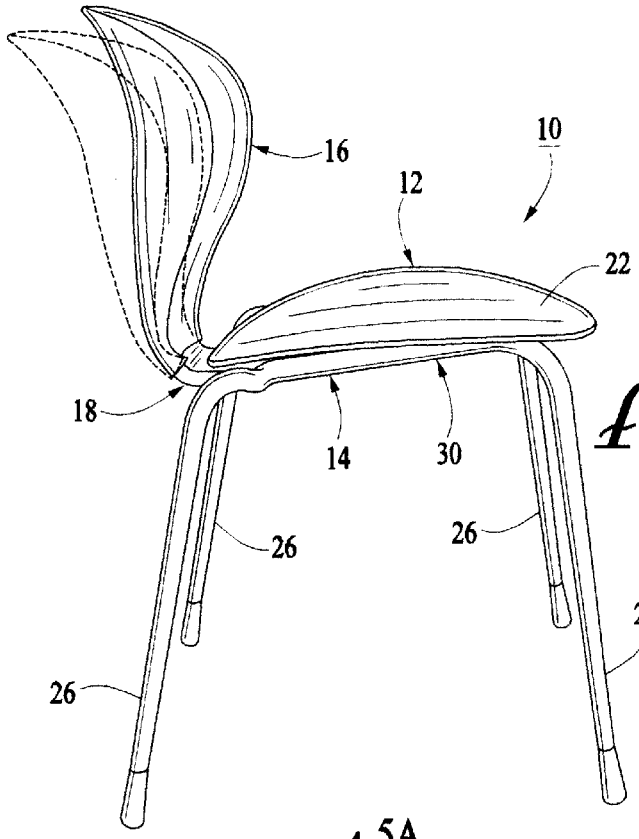
FIG. 1 is a side view of a chair having features of the invention.
Figure 2:
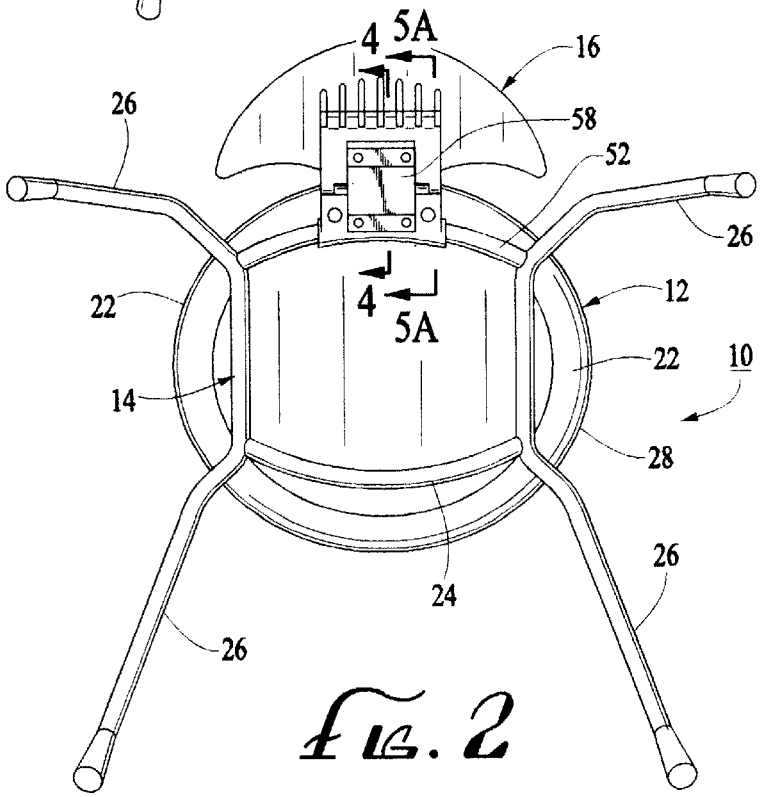
FIG. 2 is a bottom side view of the chair illustrated in FIG. 1.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a chair 10 comprising a seat 12, a seat support structure 14, a back rest 16 and a back rest support element 18.

The seat 12 is supported upon the seat support structure 14 in a generally horizontal seat plane 20. The seat 12 is preferably contoured to conform to the hips and thighs of a person seated in the chair 10. In the embodiment illustrated in the drawings, the seat 12 is contoured with upwardly sloping side portions 22. The seat 12 can be made from any suitable material. In one embodiment, the seat 12 is made from a lightweight, inexpensive plastic material.

The seat support structure 14 can be any suitable structure capable of providing a stable platform for the seat 12. In a typical embodiment, the seat support structure 14 comprises a plurality of tubular steel elements 24.

The seat support structure 14 illustrated in the drawings comprises four spaced-apart legs 26. In a preferred embodiment, the four legs 26 of the seat support structure 14 are splayed outwardly from outside the perimeter 28 of the seat 12, so that the chair 10 is stackable with chairs 10 of like design.

In another embodiment, the seat support structure 14 comprises a single vertical support post (not shown). Such an embodiment can be adapted to allow the seat to rotate about the seat support structure 14 and/or to be vertically adjustable within the support structure 14.

The seat 12 and the seat support structure 14 define a seat support combination 30.

The back rest support element 18 comprises an upper portion 32 and a lower portion 34. The lower portion 34 is attached to the seat support combination 30. The upper portion 32 is pivotally hinged to the lower portion 32 along a horizontal pivot axis 36.

Figure 3:
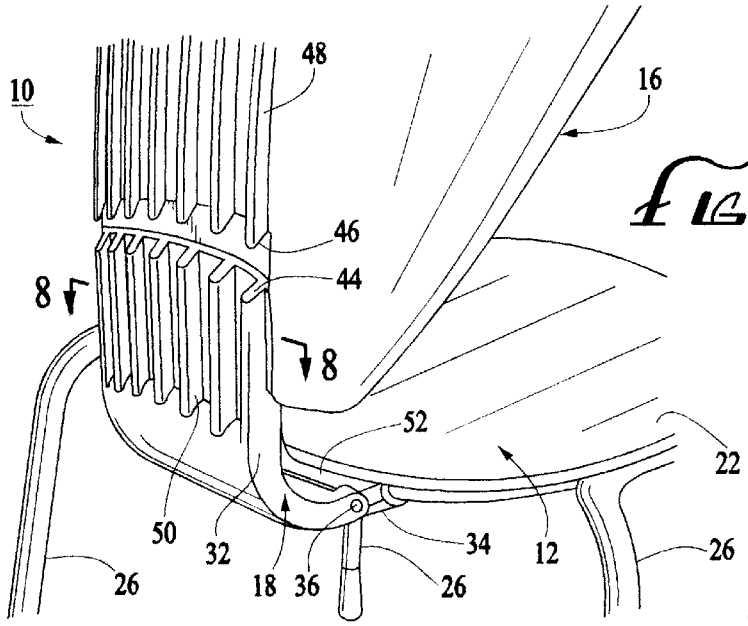
FIG. 3 is an isometric detail view showing the back of the chair illustrated in FIGS. 1 and 2.
Figure 8:
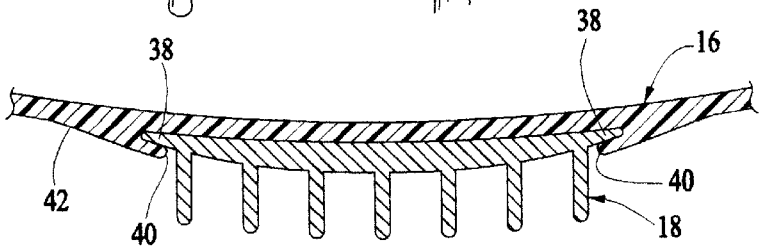
FIG. 8 is a cross-sectional top view of the chair illustrated in FIG. 3, taken along line 8—8.
Figure 4:
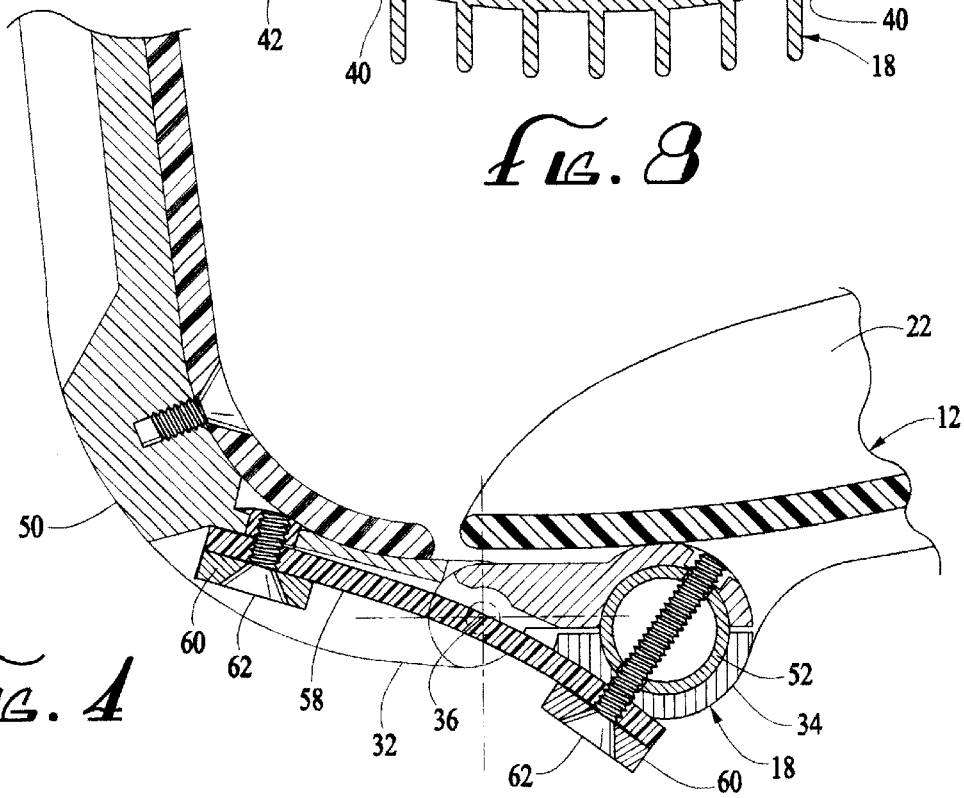
FIG. 4 is a cross-sectional detail view of the chair illustrated in FIG. 2, taken along line 4—4.

In the embodiment illustrated in the drawings, the back rest support element 18 comprises a pair of opposed lateral flanges 38 disposed within corresponding lateral slots 40 formed into the rearward side 42 of the back rest 16. This is best seen in FIGS. 3 and 9.

In the embodiment illustrated in the drawings, the upper surface 44 of the back rest support element 18 forms a dove tail fit with a shoulder element 46 defined within the rearward side 42 of the back rest 16. In the embodiment illustrated in FIG. 3, shoulder elements 18 are provided by a plurality of rearwardly extending ribs 48. Such ribs 48 also provide structural support to the back rest 16. Also in the embodiment illustrated in the drawings, the back rest support element 18 has a like number of similar ribs 50, each of which is aligned with a corresponding rib 48 on the rearward side 42 of the back rest 16. This design provides the chair 10 with an aesthetically pleasing appearance.

In a typical embodiment, the back rest support element 18 is made from a metal, such an aluminum alloy or steel.

In the embodiment illustrated in the drawings, the back rest support element 18 is clamped to a generally elongate connection element 52 in the seat support structure 14. To minimize the rotation of the back rest support element 18 about the elongate connection element 52, both the clamp portion of the back rest support element 18 and the elongate connection element 52 are curved. Most preferably, the elongate connection element 52 is provided with a compound radius of curvature, that is, the elongate connection element 52 is curved in at least two different planes.

The back rest 16 is attached to the upper portion 32 of the back rest support element 18 and is disposed in a generally vertical orientation. Because the upper portion 32 of the back rest support element 18 is pivotally hinged to the lower portion 34 of the back rest support element 18, the back rest 16 is alternatively deflectable between a forward-most position, wherein the back rest 16 is disposed in an at-rest plane 54, and a rearward most-position, wherein the back rest 16 is disposed in a full tilt plane 56. The back rest 16 is typically made from the same material from which the seat 12 is made. Like the seat 12, therefore, the back rest 16 can be made from a light, inexpensive plastic material. Also like the seat 12, the back rest 16 is preferably contoured to conform to the back of a user seated in the chair 10.

It is important that the pivot axis 36 be disposed below the chair seat plane 20 and that the intersection of the at-rest plane 54 and the seat plane 20 be rearward of the pivot axis 36. It has been found that by such a design, the back rest 16 exerts minimum shear forces against the back of an individual sitting in the chair 10. Therefore, when an individual sits in the chair 10 and leans back on the back rest 16, there is little or no upward shear force exerted on the individual's back (which would tend to pull the individuals shirt out of his or her trousers). In the embodiment illustrated in the drawings, the disposition of the pivot axis 36 below the seat plane 20 and the intersection of the at-rest plane 54 and the seat plane 20 being rearward of the pivot axis 36 are conveniently accomplished by providing a back rest support structure 18 which is arcuate in shape.

The back rest support element 18 further comprises a spring 58 installed under sufficient pre-tension to urge the back rest 16 to the forward-most position when the chair 10 is not occupied by a user. The spring 58 is chosen with suitable resilience, depending upon the size and weight of the typical user of the chair 10 and depending upon how high the back rest 16 is disposed above the seat 12. For example, for a chair 10 suitable for a typical adult, wherein the uppermost portion of the back rest 16 is disposed about 13½ inches above the pivot axis 36, a spring 58 exerting about 75 pounds of force can be used.

In the embodiment illustrated in the drawings, the spring 58 is a flat spring, made from a suitable resilient material. The flat spring 58 can be made from spring steel. However, to minimize the cost of manufacture, the flat spring 58 can be made from a non-metallic material, such as from a cross ply fiberglass. Such springs 58 typically are rectangular in structure having a width of about 2¾ inches, a length of about 3⅛ inches and a thickness of about 0.15 inches. Such flat springs 58 are commonly available in the market, such as the flat spring marketed by the 3M Company of St. Paul, Minn. as spring product SP1002.

In the embodiment illustrated in the drawings, the flat spring 58 is secured within the back rest support element 18 by a pair of spring support plates 60 and four spring attachment screws 62.

Figure 5A:
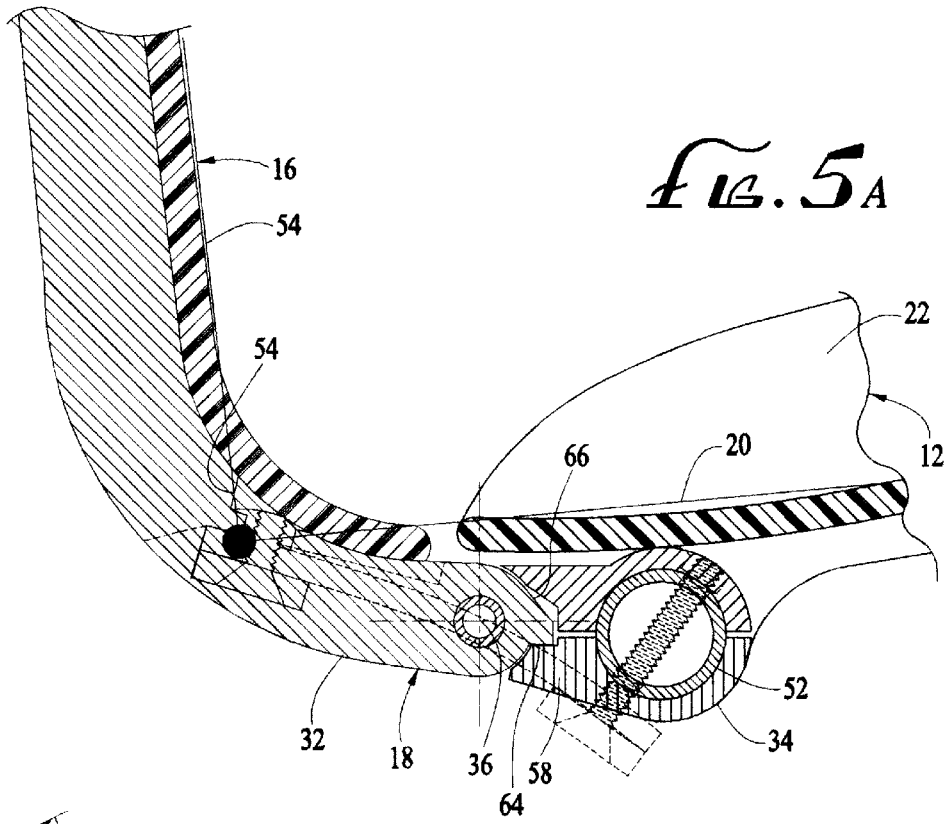
FIG. 5A is a cross-sectional detail view of the chair illustrated in FIG. 2, taken along line 5A—5A.
Figure 5B:
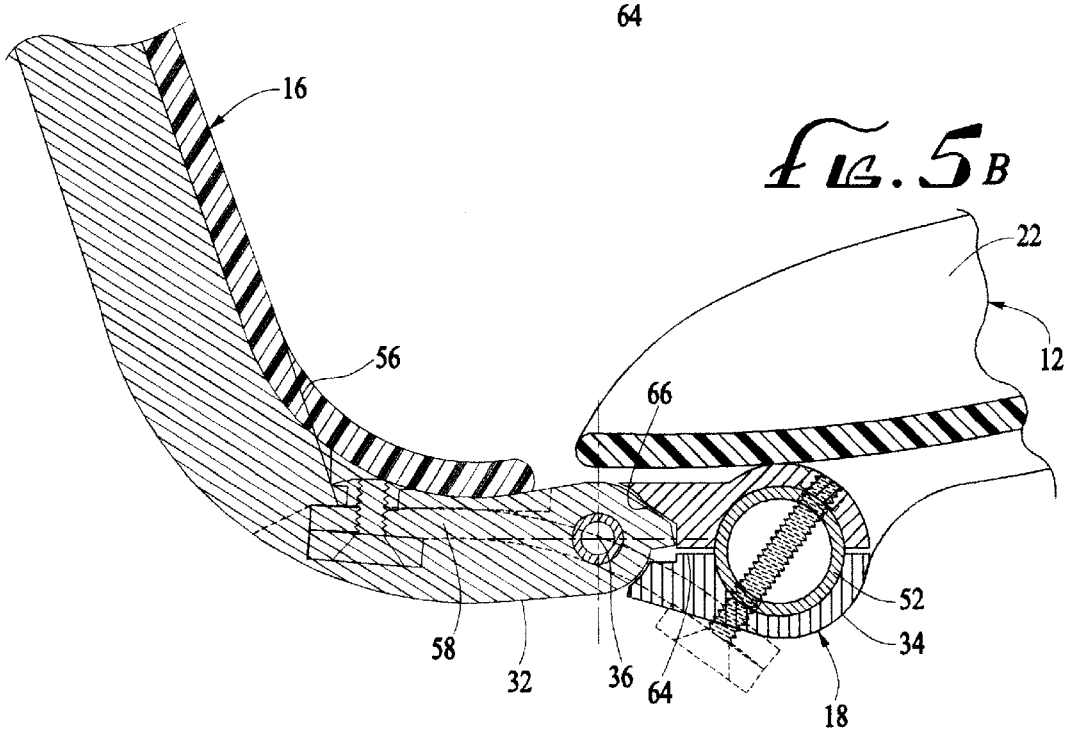
FIG. 5B is a cross-sectional detail view similar to that illustrated in FIG. 5A, except that the back rest of the chair is shown in a reclined position.
Figure 6:
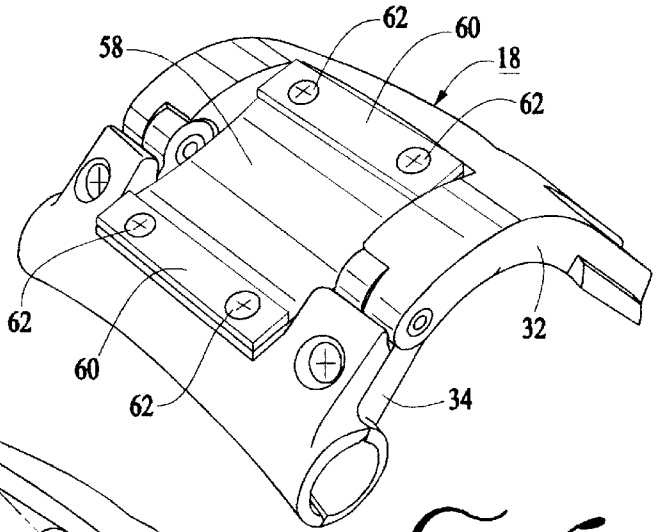
FIG. 6 is a isometric view of a back rest support element having features of the invention.
Figure 7:
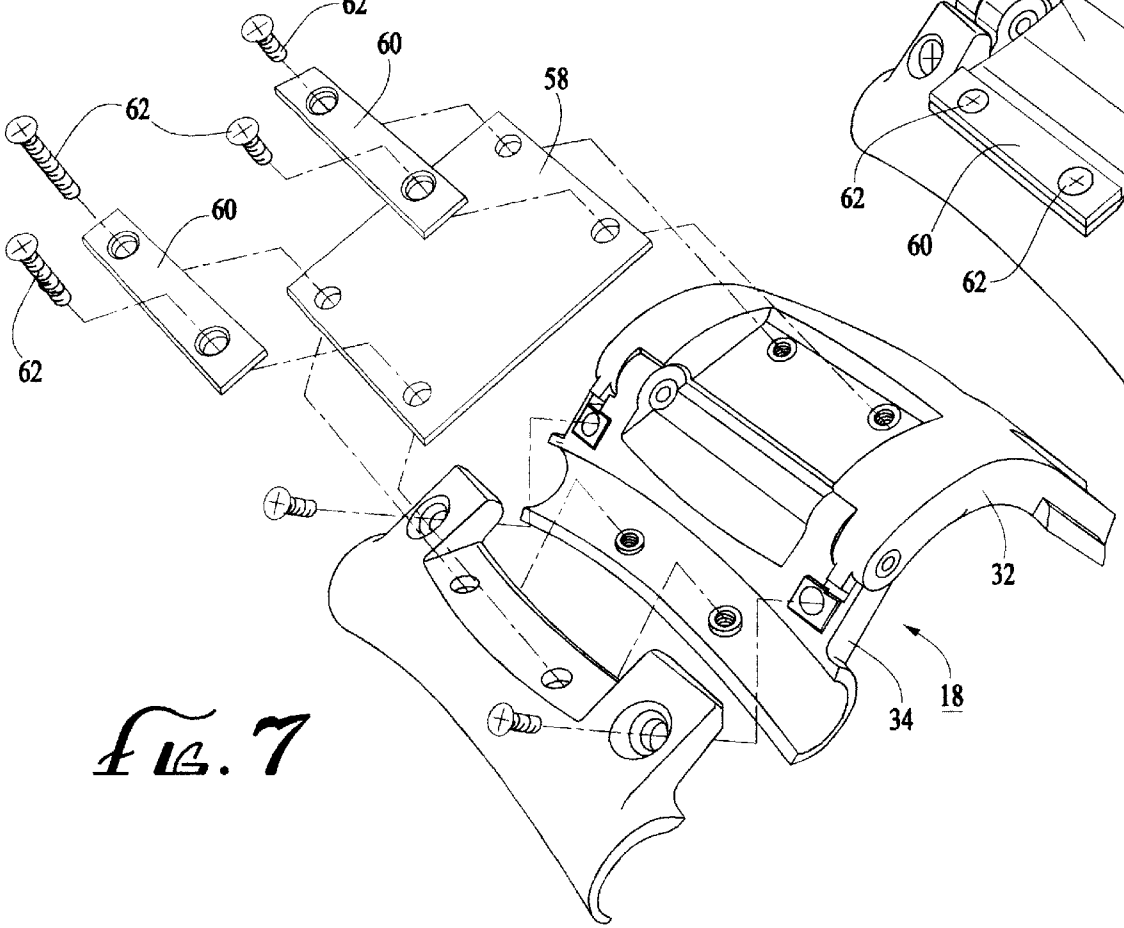
FIG. 7 is an exploded view of the back rest support element illustrated in FIG. 6.

Preferably, the back rest support element 18 further comprises an at-rest stop tab 64 and a full tilt stop tab 66. Such stop tabs 64 and 66 are best seen in FIGS. 5A and 5B. The at-rest stop tab 64 is adapted to prevent the deflection of the back rest 16 in the forward direction beyond the forward-most position. Conversely, the full tilt stop tab 66 is adapted to prevent the deflection of the back rest 16 in the rearward direction beyond the rearward-most position.

The invention has been found to provide a chair which is considerably more comfortable to sit in than chairs having a rigid back rest. The invention allows such chairs to be made by a compact design, using lightweight and inexpensive materials.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A chair having a forward side and a rearward side, and further comprising:

(a) a seat support combination comprising a seat support structure and a seat supported upon the seat support structure, the seat having a top side disposed in a generally horizontal seat plane;

(b) a back rest support element having an upper portion and a lower portion, the upper portion being pivotally hinged to the lower portion along a horizontal pivot axis, the lower portion being attached to the seat support combination by a clamp, the pivot axis being disposed below the generally horizontal seat plane;

(c) a back rest attached to the upper portion of the back rest support element, the back rest having a forward side and a rearward side, the back rest being alternatively deflectable between a forward-most position wherein the back rest is disposed in an at-rest plane and a rearward-most position wherein the back rest is disposed in a full tilt plane, the intersection of the at rest plane and the seat plane being rearward of the pivot axis;

(d) the upper portion or the lower portion of the back rest support element further comprising an at-rest stop tab for preventing the deflection of the back rest in the forward direction, beyond the forward-most position;

(e) the upper portion or the lower portion of the back rest support element further comprising a full tilt stop tab for preventing the deflection of the back rest in the rearward direction beyond the rearward-most position; and (f) a flat spring disposed within the back rest support element under sufficient pre-tension to urge the back rest to the forward-most position when the chair is unoccupied.

2. The chair of claim 1 wherein the back rest support element comprises an upper surface which forms a dove tail fit with a shoulder element defined within the rearward side of the back rest.

3. The chair of claim 1 wherein the back rest support element comprises a plurality of vertical ribs.

4. The chair of claim 1 wherein the seat and the back rest are made of a plastic material.

5. The chair of claim 1 wherein the back rest support element comprises a back rest support plate comprised substantially of an aluminum alloy.

6. The chair of claim 1 wherein the seat support structure comprises four spaced apart, generally vertical legs.

7. The chair of claim 6 wherein the chair is stackable with chairs of identical design.

8. The chair of claim 1 wherein the upper portion of the back rest support element is arcuate.

9. The chair of claim 1 wherein the spring is made from a non-metallic material.

10. The chair of claim 1 wherein the seat support structure comprises a rearward facing, generally horizontal elongate connection element having a compound radius of curvature, and wherein the lower portion of the backrest support element is clamped to the elongate connection element.

11. The chair of claim 1 wherein the rearward side of the back rest comprises a pair of lateral slots and wherein the back rest support structure comprises a pair of opposed lateral flanges, each of which is disposed within one of the lateral slots.

12. The chair of claim 1 wherein the flat spring is connected between the upper portion of the back rest support element and the lower portion of the back rest support element.

13. A chair having a forward side and a rearward side, and further comprising:

(a) a seat support combination comprising a seat support structure and a seat supported upon the seat support structure, the seat support structure having four spaced apart, generally vertical legs, the seat support structure also having a rearward facing, generally horizontal elongate connection element with a compound radius of curvature, the seat having a top side disposed in a generally horizontal seat plane;

(b) a back rest support element having an upper portion and a lower portion, the upper portion being pivotally hinged to the lower portion along a horizontal pivot axis, the lower portion being clamped to the elongate connection element of the seat support structure, the pivot axis being disposed below the generally horizontal seat plane, (c) a back rest attached to the upper portion of the back rest support element, the back rest having a forward side and a rearward side, the back rest being alternatively deflectable between a forward-most position wherein the back rest is disposed in an at-rest plane and a rearward-most position wherein the back rest is disposed in a full tilt plane, the intersection of the at-rest plane and the seat plane being rearward of the pivot axis; and (d) a nonmetallic spring disposed within the back rest support element under sufficient pre-tension to urge the back rest to the forward-most position when the chair is unoccupied.

14. The chair of claim 13 wherein the seat and the back rest are made of a plastic material, and wherein the back rest support element comprising a plurality of vertical ribs.

15. The chair of claim 13 wherein the chair is stackable with chairs of identical design.

16. The chair of claim 13 wherein the spring is a flat spring.

17. The chair of claim 13 wherein the spring is made from a fiber glass.

18. The chair of claim 13 wherein the rearward side of the back rest comprises a pair of lateral slots and wherein the back rest support structure comprises a pair of opposed lateral flanges, each of which is disposed within one of the lateral slots.

19. The chair of claim 13 wherein the nonmetallic spring is connected between the upper portion of the back rest support element and the lower portion of the back rest support element.

20. A chair having a forward side and a rearward side, and further comprising:

(a) a seat support combination comprising a seat support structure and a seat supported upon the seat support structure, the seat support structure having four spaced apart, generally vertical legs, the seat having a top side disposed in a generally horizontal seat plane;

(b) a back rest support element having a forward side, a rearward side, an upper portion and a lower portion, the upper portion being pivotally hinged to the lower portion along a horizontal pivot axis, the lower portion being clamped to the seat support combination, the pivot axis being disposed below the generally horizontal seat plane, the back rest support element further comprising a rearward facing, generally horizontal elongate connection element having a compound radius of curvature, and wherein the lower portion of the backrest support element is clamped to the elongate connection element, (c) a back rest attached to the upper portion of the back rest support element, the back rest being alternatively deflectable between a forward-most position wherein the back rest is disposed in an at-rest plane and a rearward-most position wherein the back rest is disposed in a full tilt plane, the intersection of the at rest plane and the seat plane being rearward of the pivot axis wherein a rearward side of the back rest comprises a pair of lateral slots and the upper portion of the back rest support element comprises a pair of opposed lateral flanges, each of which is disposed within one of the lateral slots; and (d) a nonmetallic spring disposed between the upper portion of the back seat and the lower portion of the back seat under sufficient pre-tension to urge the back rest to the forward-most position when the chair is unoccupied;

wherein the chair is stackable with chairs of identical design.

21. The chair of claim 20 wherein the seat and the back rest are made of a plastic material.

22. The chair of claim 20 wherein the spring is a flat spring.

23. The chair of claim 20 wherein the spring is made from a fiber glass.

* * * * *